US009117575B2

(12) United States Patent
Schott et al.

(10) Patent No.: US 9,117,575 B2
(45) Date of Patent: Aug. 25, 2015

(54) ELECTRICAL POWER RESISTOR

(75) Inventors: Bertram Schott, Selb (DE); Otto Hampl, Getrees (DE)

(73) Assignee: Vishay Electronic GmbH, Selb (DE)

( * ) Notice: Subject to any disclaimer, the term of this patent is extended or adjusted under 35 U.S.C. 154(b) by 267 days.

(21) Appl. No.: 13/884,415

(22) PCT Filed: Dec. 1, 2011

(86) PCT No.: PCT/EP2011/006050

§ 371 (c)(1),
(2), (4) Date: Aug. 29, 2013

(87) PCT Pub. No.: WO2012/072262

PCT Pub. Date: Jun. 7, 2012

(65) Prior Publication Data

US 2013/0328660 A1 Dec. 12, 2013

(30) Foreign Application Priority Data

Dec. 3, 2010 (DE) ..... 10 2010 053 389

(51) Int. Cl.

| | |
|---|---|
| ***H01C 7/18*** | (2006.01) |
| ***H01C 1/00*** | (2006.01) |
| ***H01C 1/016*** | (2006.01) |
| ***H01C 7/00*** | (2006.01) |

(52) U.S. Cl.
CPC ..... *H01C 1/00* (2013.01); *H01C 1/016* (2013.01); *H01C 7/001* (2013.01)

(58) Field of Classification Search
CPC ..... H01C 7/001; H01C 1/084; H01C 1/08; H01C 17/02; H01C 3/10
USPC ..... 338/204
See application file for complete search history.

(56) References Cited

U.S. PATENT DOCUMENTS

| | | | | |
|---|---|---|---|---|
| 2,769,885 | A | 4/1954 | Charbonneau | |
| 3,299,388 | A * | 1/1967 | Bundy | 338/284 |
| 3,541,491 | A * | 11/1970 | Worster | 338/211 |
| 5,068,637 | A * | 11/1991 | Bayer | 338/57 |
| 5,192,940 | A * | 3/1993 | Yajima et al. | 338/308 |
| 5,917,404 | A * | 6/1999 | Campbell | 338/315 |
| 6,329,900 | B1 * | 12/2001 | Everett | 338/316 |
| 7,932,808 | B2 | 4/2011 | Wobben | |

FOREIGN PATENT DOCUMENTS

| | | | |
|---|---|---|---|
| DE | 950867 | B | 10/1956 |
| DE | 1146956 | A | 4/1963 |
| DE | 3933956 | A1 | 4/1991 |
| DE | 42 25 724 | A1 | 7/1993 |
| DE | 42 25 723 | A1 | 2/1994 |
| DE | 102004033680 | A1 | 1/2006 |
| EP | 0 585 611 | A2 | 3/1994 |

* cited by examiner

*Primary Examiner* — Kyung Lee
(74) *Attorney, Agent, or Firm* — Volpe and Koenig, P.C.

(57) ABSTRACT

An electric power resistor has a stack of a plurality of resistor plates of metal. Each resistor plate has at least one meandering structure which is formed by a plurality of alternately mutually connected transverse webs. Resistor plates following one another in the stack direction are rotated by 90° with respect to one another.

19 Claims, 3 Drawing Sheets

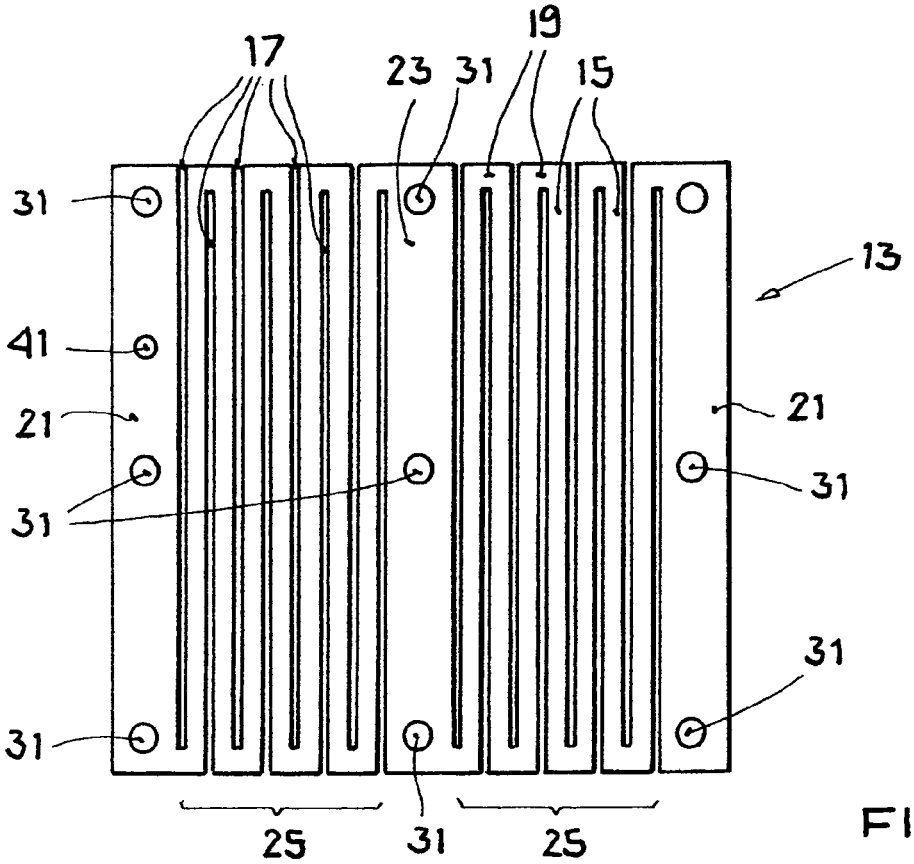
FIG. 4
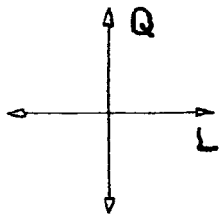

ELECTRICAL POWER RESISTOR

The invention relates to an electric power resistor which is typically used in electric generators and frequency converters. Such a power resistor serves for converting electric energy into thermal energy in special operating states in electric plants in which the electric energy present typically has to be significantly reduced in time periods from some milliseconds to some seconds. This is the case, for example, in wind turbines and water power plants.

Such a power resistor can be formed by a stack of a plurality of resistor plates of metal, with each resistor plate of the stack having at least one meandering structure which is formed by a plurality of transverse webs following one another and alternately connected to one another. A resistor unit is hereby provided which can easily be matched to the respective use with a simple construction.

However, mechanical stability problems can occur with such a resistor unit. If namely an electric current flows through the respective resistor plate, the current flows in opposite directions in mutually adjacent transverse webs. The interaction of the magnetic fields induced in the adjacent transverse webs results in a mutual repulsion of the transverse webs. The respective resistor plate is, however, flexible due to the intermediate spaces present between the adjacent transverse webs. The mutual repulsion of the transverse webs therefore results in an expansion of the resistor plate within the plate plane perpendicular to the orientation of the transverse webs, i.e. along the direction of extent of the meandering structure (also called the "longitudinal direction" of the respective resistor plate in the following). The individual resistor plates therefore have to be inserted into a stable holder or other fastening device which takes up the explained expulsion and expansion forces and gives the formed resistor unit the required mechanical stability. Such a holder or other fastening device in particular has to prevent a tearing off of the end regions of the respective resistor plate and must ensure a sufficient shape stability of the resistor unit with respect to a fastening of the power resistor to another structure (e.g. in a switch cabinet).

It is an object of the invention to provide an electric power resistor which has a stack of a plurality of resistor plates having a meandering structure and which allows a stable arrangement of the resistor plates with a simple and inexpensive design despite the expansion forces arising therein.

This object is satisfied by an electric power resistor having the features of claim 1 and in particular in that resistor plates following one another in the stack direction are rotated by 90° with respect to one another.

The power resistor includes a stack of at least two resistor plates which are arranged over one another along the stack direction, in particular parallel to one another and spaced apart from one another. The alignment of every second resistor plate is rotated by 90° in the respective plate plane relative to the alignment of the preceding resistor plate, and indeed with respect to the respective direction of extent of the meandering structure (i.e. the longitudinal direction). This means that the repulsion and expansion forces occurring perpendicular to the orientation of the transverse webs of the respective resistor plate are likewise rotated by 90° with respect to one another from resistor plate to resistor plate. The transverse webs and/or the end connector webs of a respective resistor plate provided at the ends of the meandering structure and extending in parallel to the transverse webs can hereby take up the repulsion and expansion forces of an adjacent resistor plate (rotated by 90°). There are thus much smaller mechanical demands on the holder or fastening device which is provided for the mutual fastening of the resistor plates in comparison with an arrangement of the resistor plates having an unchanging alignment.

All resistor plates of the stack are preferably fastened to one another by means of a common fastening device. Such a fastening device can have a simple and inexpensive construction since it mainly only has to be achieved that the expansion forces of the one resistor plate occurring in the longitudinal direction are transmitted to the adjacent resistor plate or resistor plates (rotated by 90°). Due to the inherent stability of the resistor plates in the transverse direction, i.e. along the direction of extent of the transverse webs of the respective meandering structure, forces in this direction can be taken up by a resistor plate without special demands having to be made on the fastening device for this purpose.

In accordance with a particularly advantageous embodiment, the resistor plates are quadrangular, with pointed or rounded corners. The resistor plates are preferably rectangular, in particular square, with, in the case of unequal side lengths—the longer side length not necessarily defining the aforesaid longitudinal direction (which is solely determined by the direction of extent of the meandering structure of the resistor plate). In the case of such quadrangular resistor plates, a fastening opening for receiving a respective fastening element is preferably provided at least in the region of each corner. A particularly simple and nevertheless stable fastening of the resistor plates to one another is hereby possible. The fastening openings of the different resistor plates are preferably arranged aligned with one another. Common fastening elements can thus be used which are led through the aligned fastening openings.

The resistor plates of the stack can, for example, be fastened to one another via fastening bars which are led through the fastening openings of the resistor plates. The fastening bars can be threaded bars or screws. A self-supporting structure of the stack is hereby formed in a simple manner without an outer holder, for example in the form of a cage, being required for the mutual fastening of the resistor plates.

The named fastening elements, in particular the named fastening bars, are preferably electrically insulated from the resistor plates. This can take place, for example, by plugged on mica pipes.

In accordance with an embodiment, the arrangement of the named fastening openings and fastening elements is rotationally symmetrical with respect to a rotation of the respective resistor plate by 90°. This means that the fastening openings of a resistor plate are also aligned with the fastening openings of another resistor plate adjacent thereto when the named one resistor plate is rotated by 90° relative to the other resistor plate. The power resistor can hereby be reconfigured even more simply for other applications since the resistor plates can be combined with one another in a particularly flexible manner and the resistor plates can be designed as common parts.

It is furthermore preferred if at least two of the resistor plates have at least one respective connector means for the electric contacting of the resistor plate. This connector means can be formed, for example, as an opening (e.g. a bore) or as a plugged in, placed on and/or welded on bolt. If a plurality of resistor plates, or all resistor plates, of the stack are provided with the same connector means, the matching of the power resistor to a desired resistor value can take place in a particularly flexible manner. For example, each resistor plate can have a connector means for the electric contacting at the two ends of the meandering structure.

It is furthermore preferred if at least one of the resistor plates has at least one respective connection means for fastening an insulator. The named connection means can, for example, be openings, screws or bolts. The insulators fastened to the respective resistor plate allow an arrangement and a fastening of the power resistor to another structure, for example in a switch cabinet, Provided that a respective resistor plate is provided with the named fastening openings, connector means and connection means, three groups of different mechanical and/or electric means are available which can be introduced in a simple manner by means of the same tool (if it is a question of bores, for example).

In accordance with a further advantageous embodiment, two resistor plates following one another in the stack direction are separated from one another by respective spacers, with the spacers selectively being able to be made as electrically insulating or electrically conductive. The spacers effect a predefined spacing of the resistor plates, preferably arranged in a planoparallel manner, relative to one another. A respective intermediate space is thus formed between two adjacent resistor plates in the stack direction which can in particular be used for cooling purposes (air cooling or liquid cooling). The respective spacing between two adjacent resistor plates can be set flexibly in dependence on the desired application by the use of separate spacers. The spacers can be formed be sleeves which allow a particularly good air circulation between the resistor plates and thus a good heat dissipation to the environmental air. Alternatively, throughgoing spacers can also be provided, for example in the form of webs or plates. In particular ceramics, mica, rubber, silicone or plastic can be considered as electrically insulating materials. The power resistor can form a parallel circuit or a series circuit of the individual resistor plates of the stack by a corresponding selection of electrically insulating or electrically conductive spacers, or also a number of individual resistors (if all resistor plates are electrically insulated from one another).

The resistor plates preferably have a respective end connector web (a so-called terminal), which is made wider than the transverse webs of the meandering structure, at the two ends of the meandering structure, i.e. disposed along the respective longitudinal direction. The already named fastening openings for the fastening device can thus be provided at the particularly stable end connector webs to be able to reliably take up the explained expansion forces of the respective adjacent resistor plate. Alternatively or additionally, the named fastening openings can, however, also be provided at the transverse webs.

In addition to the named end connector webs, the resistor plates can have at least one center connector web, which is likewise made wider than the transverse webs, in a respective center region. The meandering structure of the respective resistor plate which forms the active region of the electric resistor is hereby divided into a plurality of segments. These segments can be of the same or different shapes and they can have the same or a different electric resistance. Such a center connector web also contributes to increasing the mechanical stability in the transverse direction. Further fastening openings for receiving a respective fastening element are preferably provided at the center connector web in addition to the fastening openings at the end connector webs. It is furthermore preferred if at least one connector means (e.g. an opening or bolt) is provided at the respective center connector web for the electric contacting.

In accordance with a further advantageous embodiment, the transverse webs of the meandering structure of a respective resistor plate are electrically insulated from one another along the intermediate spaces formed between two adjacent transverse webs, and indeed either only sectionally or over the full length of the respective intermediate space. Unwanted arc ignitions can hereby be prevented. The deformation of the individual transverse webs can namely be so strong due to the magnetic interaction or also due to thermal expansion or external vibrations that transverse webs arranged adjacent to one another touch one another or at least almost contact one another briefly. This effect can result in the ignition of an arc which could damage or destroy the power resistor or the associated electric plant. This danger is prevented by a mutual electric insulation of the transverse webs and, conversely, the intermediate spaces between two adjacent transverse webs can be made narrow, which contributes to an increased stability and a compact construction.

The mutual electric insulation of the transverse webs can n particular be effected by insulating strips (i.e. electrically insulating strip-shaped plates) which are inserted into the intermediate spaces between two adjacent transverse webs and which in particular comprise ceramics, mica or plastic, for example polybenzimidazole (PBI). Instead of such insulating strips, a granulate or another filler material can be pressed into the intermediate spaces between two adjacent transverse webs, for example heated polybenzimidazole. Alternatively, a sufficiently hardened liquid insulating material can be used which completely or partly fills the intermediate spaces between two adjacent transverse webs by pouring, injecting or foaming, for example silicone, cement or concrete. A sufficiently hardened liquid insulating material can furthermore be used which covers the transverse webs as a coat, for example in the form of a thin polybenzimidazole film which forms a protection from moisture in addition to the electric insulation (corrosion protection).

A particularly simple and inexpensive production of the individual resistor plates results when the meandering structure of each resistor plate is formed by alternate incisions which are preferably arranged offset from one another. The incisions between adjacent transverse webs can be introduced, for example, by means of a laser beam, a high-pressure water jet, a saw or a mill, in particular in the same workstep in which the respective resistor plate is cut out of a larger plate.

In accordance with an advantageous embodiment, all resistor plates of the stack, or all resistor plates of the stack, with the exception of a base plate, are made identical to one another, i.e. as common parts. A particularly inexpensive manufacturing and storage hereby results and the respective power resistor can be configured in a flexible manner.

The invention will be explained in the following only by way of example with reference to the drawings.

FIG. 4 shows a plan view of a third resistor plate; and

Figure 1:
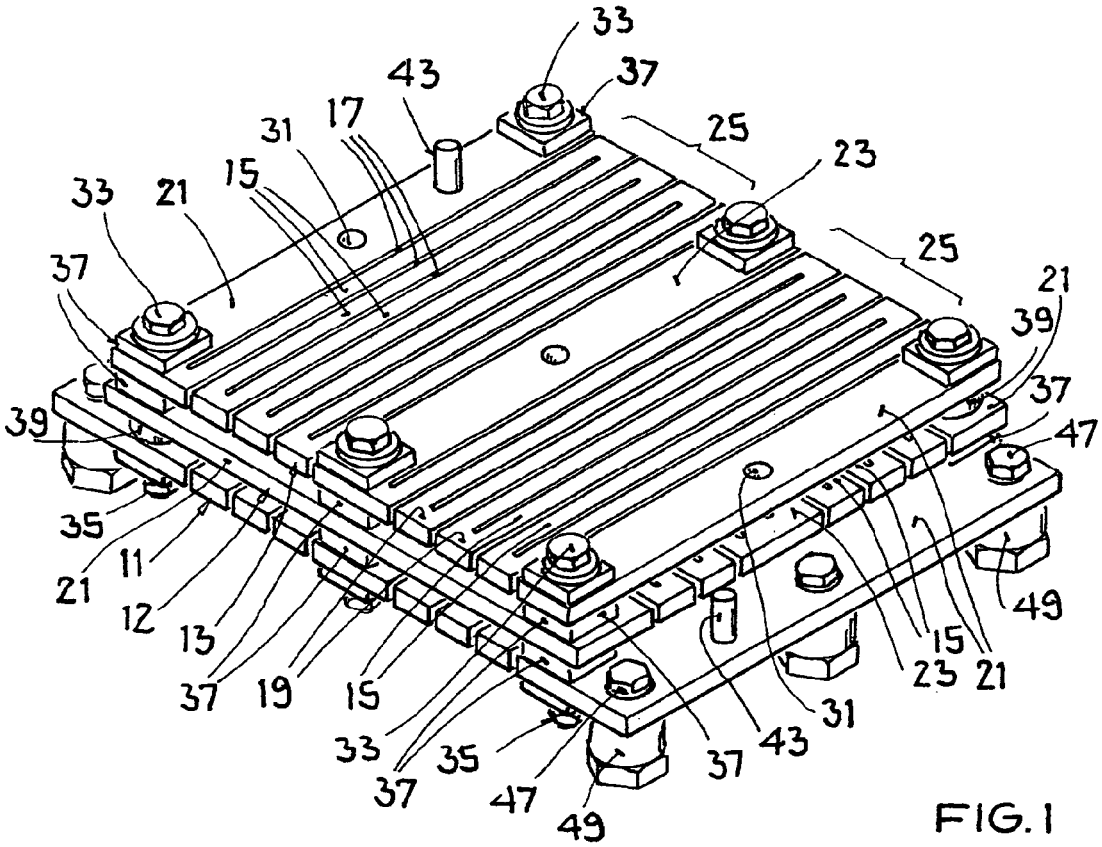
FIG. 1 shows a perspective view of an electric power resistor.
Figure 2:
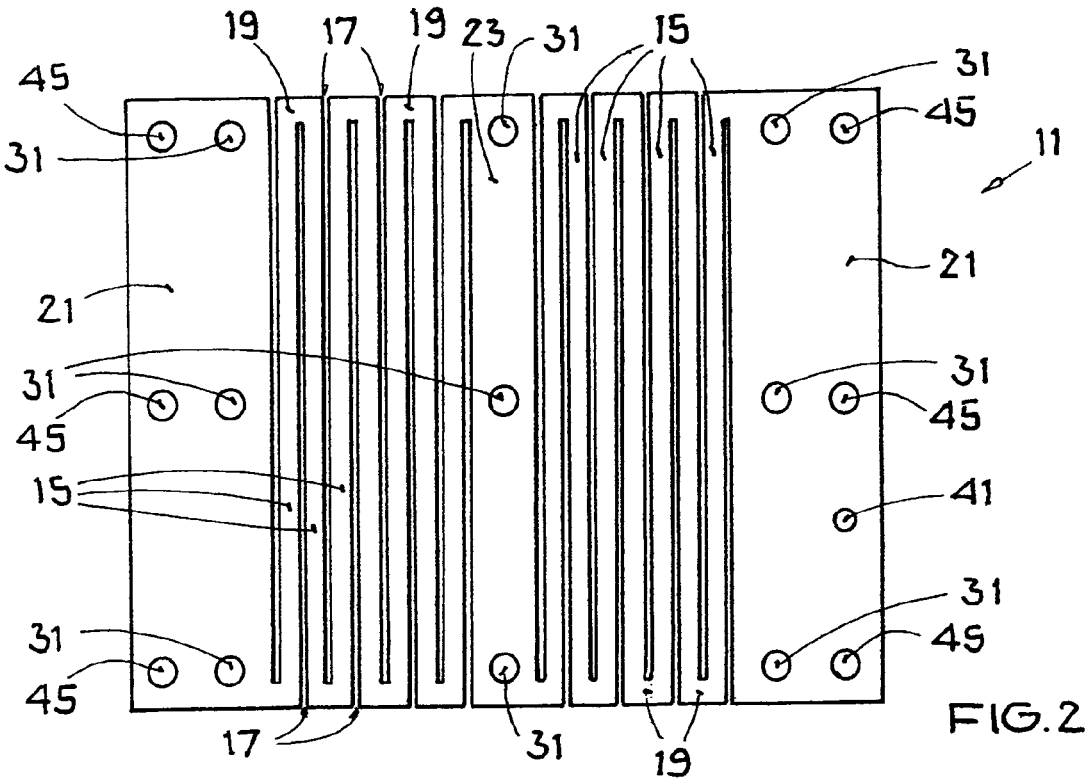
FIG. 2 shows a plan view of a first resistor plate.
Figure 3:
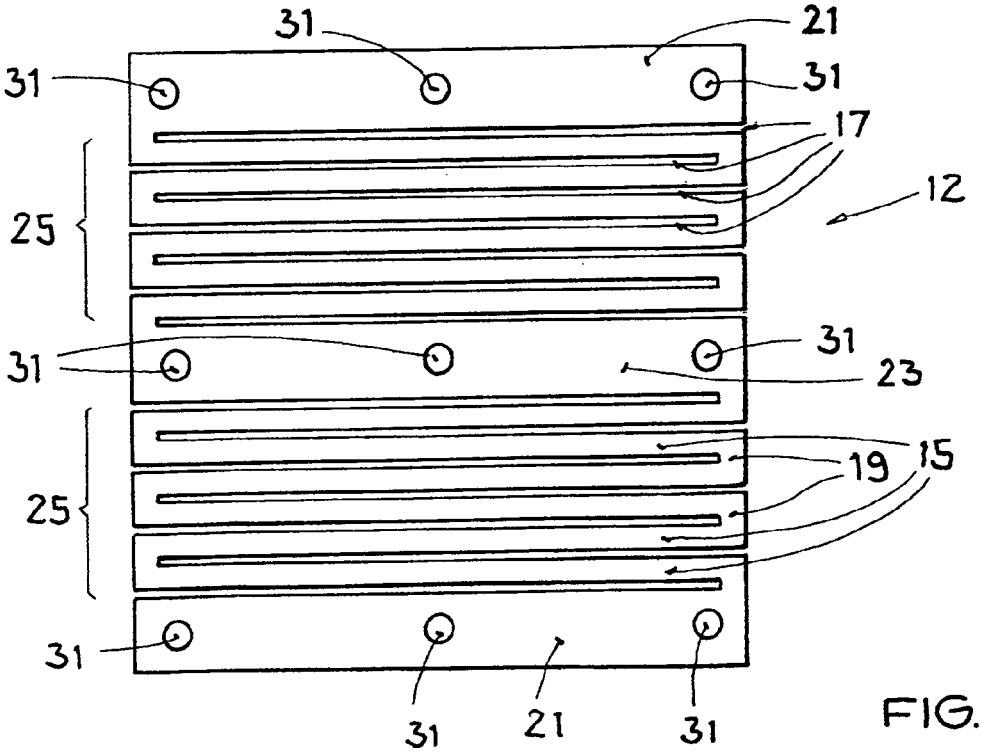
FIG. 3 shows a plan view of a second resistor plate.

The power resistor shown in FIG. 1 includes a stack of resistor plates arranged in a planoparallel manner with respect to one another, namely with a first resistor plate 11 (FIG. 2) forming a base plate, a second resistor plate 12 (FIG. 3) and a third resistor plate 13 (FIG. 4). The rectangular resistor plates 11, 12, 13 comprise metal, typically stainless steel or another suitable alloy and can also have, differing from the representation in FIGS. 1 to 4, rounded corners. The resistor plates 11, 12, 13 are fastened to one another and are electrically conductively connected to one another, as will be explained in the following.

Each resistor plate 11, 12, 13 has a meandering structure which is formed by a plurality of transverse webs 15 following one another. Mutually adjacent transverse webs 15 are alternately separated from one another by a slit-shaped intermediate space 17 and are connected to one another by means of a short connection web 19. As is shown by way of example for the third resistor plate 13 in FIG. 4, the transverse webs 15 extend along a transverse direction Q, whereas the thus formed meandering structure of the respective resistor plate extends perpendicular to the orientation of the transverse webs 15 and to the transverse direction Q, namely along a longitudinal direction L. In the embodiment shown here, the transverse webs 15 extend over the full side length of the respective resistor plate 11, 12, 13. Instead of the shown single respective meandering structure, the resistor plates 11, 12, 13 can, however, also include a plurality of meandering structures which extend next to one another.

Each resistor plate 11, 12, 13 has a respective end connector web 21, which is made wider than the transverse webs 15, at the two ends of the meandering structure. Each resistor plate 11, 12, 13 furthermore has a center connector web 23, which is likewise made wider than the transverse webs 15, in a center region. The center connector web 23 divides the meandering structure of the respective resistor plate 11, 12, 13 into two active regions 25.

As can be recognized from the perspective view in accordance with FIG. 1, the resistor plates 11, 12, 13 following one another in the stack direction are rotated by 90° with respect to one another with respect to the respective direction of extent of the meandering structure (respective longitudinal direction L in accordance with FIG. 4). In other words, the second resistor plate 12 is rotated by 90° relative to the first resistor plate 11 within the plate plane and the third resistor plate 13 is in turn rotated by 90° relative to the second resistor plate 12 within the plate plane. The orientation of the transverse webs 15 of two adjacent resistor plates 11 and 12 or 12 and 13 is accordingly rotated by 90°.

Each resistor plate 11, 12, 13 has nine fastening openings 31: Four fastening openings 13 are provided in the region of the corners of the respective resistor plate 11, 12, 13. A respective further fastening opening 31 is provided in a center region of the end connector webs 21. Finally, the respective center connector web 23 also has three fastening openings 31, namely at the two ends and in a center region. A matrix of 3×3 fastening openings 31 hereby results.

The respective fastening openings 31 of the three resistor plates 11, 12, 13 are arranged in alignment with one another and serve for receiving a common fastening device which includes a plurality of fastening elements 33 common to the three resistor plates 11, 12, 13. In the example shown here, only six fastening elements 33 are provided, i.e. three fastening openings 31 of the respective resistor plates 11, 12, 13 remain unused.

The fastening elements 33 in the embodiment shown here are formed as hexagon screws which cooperate with hexagon nuts 35 to hold the stack of resistor plates 11, 12, 13 together.

In this respect, spacers ensure that the resistor plates 11, 12, 13 are arranged spaced apart from one another. On the one hand, electrically insulating spacers 37 are provided, for example mica platelets having a passage opening for the respective fastening element 33. On the other hand, electrically conductive spacers 39 (e.g. metal sleeves) ensure that an end connector web 21 of a resistor plate is connected electrically conductively to an end connector web 21 of another resistor plate 11, 12, 13.

In addition to the named fastening openings 31, connector means are provided at an end connector web 21 of the first resistor plate 11 and at an end connector web 21 of the third resistor plate 13, said connector means serving for the electric contacting of the power resistor with the associated electric plant. The respective connector means include a connector opening 41 (FIGS. 2 and 4) into which a connector bolt 43 is inserted (FIG. 1). A cable lug (not shown) can be fastened to the respective connector bolt 43, for example. Such connector means (connector opening 41 with connector bolt 43) can also be provided at the center connector web 23 of at least the third resistor plate 13 to be able to match the resistance value of the power resistor shown even more flexibly and to be able to utilize the power resistor as a potential divider.

Connection means are furthermore provided at the first resistor plate 11 for fastening an insulator to be able to fasten the power resistor to an associated support structure (e.g. in a switch cabinet). These connection means include six connection openings 45 (FIG. 2) into which a respective connection screw 47 is introduced which is screwed to a respective insulation block 49 (FIG. 1).

Figure 5:
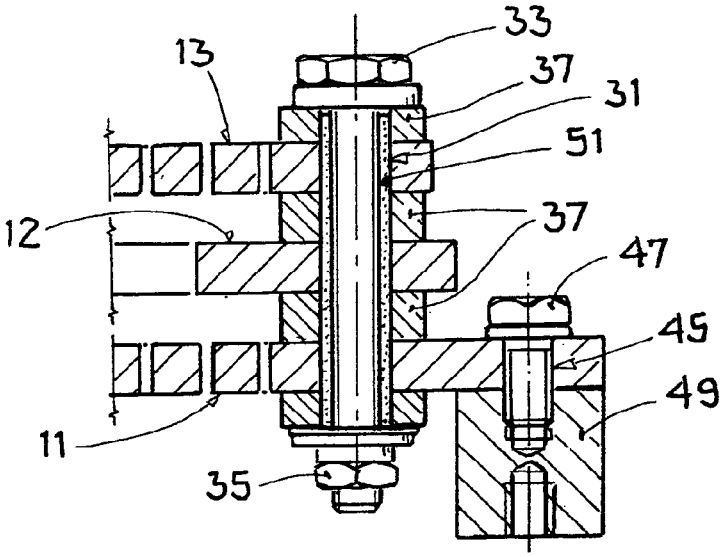
FIG. 5 shows a detail of a cross-sectional view.

FIG. 5 shows a detailed view of the power resistor in accordance with FIG. 1 in cross-section. It can be recognized that the fastening element 33, that is the hexagon screw, is surrounded by a mica pipe 51 which likewise penetrates the fastening openings 31 of the resistor plates 11, 12, 13 and thus electrically insulates the hexagon screw from the resistor plates 11, 12, 13.

The power resistor shown in FIGS. 1 to 5 has a simple design and can be manufactured in an inexpensive manner. The resistor plates 11, 12, 13 can be cut out of larger plates, with at the same time the intermediate spaces 17 being able to be introduced as incisions to form the transverse webs 15 of the respective meandering structure. The fastening openings 31, the connector openings 41 and the connection openings 45 can be designed in a simple manner as bores. The desired resistance value of the respective resistor plate 11, 12, 13 can be set by a suitable choice of the material, of the size and of the thickness of the resistor plates 11, 12, 13, of the number of transverse webs 15 and intermediate spaces 17 as well as of the width of the transverse webs 15. Any desired ratio of the width of the transverse webs 15 to the thickness of the respective resistor plate 11, 12, 13 can generally be realized in this respect, for example the ratio one (i.e. quadratic cross-section). It is also possible to manufacture the resistor plates 11, 12, 13 by stamping, with then, however, larger ratios of web width to plate thickness having to be provided.

The power resistor can be flexibly matched to different demands, for example in that the number of resistor plates 11, 12, 13 of the stack is changed or in that a series circuit or a parallel circuit is selectively realized by changing the arrangement of the electrically insulating spacers 37 and of the electrically conductive spacers 39. In addition, the power resistor can be utilized as a potential divider due to the division into two active regions 25 by the center connector web 23 of the respective resistor plate 11, 12, 13. If the voltage drop is measured at the power resistor or at parts of the power resistor, the power resistor can be used as a current sensor. The resistance value of the power resistor can be equalized in a simple manner by means of an electrically conductive bridge which connects two transverse webs 15 across an intermediate space 17 (e.g. by clamping or welding), for example.

A stable, self-supporting structure is created in a simple manner by the mutual tensioning of the resistor plates 11, 12, 13 to form a stack by means of the fastening elements 33 shown in FIG. 1. It is of particular advantage in this respect that the resistor plates 11, 12, 13 are each rotated by 90° with respect to one another along the stack direction. The magnetic repulsion forces generated by the current flow in the transverse webs 15 namely result in expansion forces which are directed perpendicular to the orientation of the transverse webs 15 (along the respective longitudinal direction L in accordance with FIG. 4). These expansion forces can be taken up via the fastening elements 33 by the relatively wide end connector webs 31 (and optionally by the center connector web 23) of the respective adjacent resistor plate 11, 12, 13. The named expansion forces therefore do not have to be taken up by an outer supporting structure and care only has to be taken that the fastening elements 33 (e.g. hexagon screws) have a sufficiently large dimension.

In the embodiment shown, the matrix of the 3×3 fastening openings 31 of the three resistor plates 11, 12, 13 is rotationally symmetrical with respect to a rotation of the respective resistor plate 11, 12, 13 by 90°. The power resistor can hereby be reconfigured even more easily for other applications since a plurality of available types of resistors plates can thus be combined with one another in a particularly flexible manner. It is in particular also hereby possible to use common parts for adjacent resistor plates of a stack, whereby the manufacturing and storage effort is reduced. Alternatively to this, however, a non-rotationally symmetrical arrangement of the fastening openings 31 can be provided in order hereby to realize a direction encoding and to ensure that the individual resistor plates 11, 12, 13 can only be assembled in a single predefined alignment relative to on another. It can therefore hereby be ensured in a simple manner that the alignment of the respective direction of extent of the meandering structure of adjacent resistor plates 11, 12, 13 rotated by 90° with respect to one another is always maintained.

It must finally be noted with respect to the shown embodiment that the intermediate spaces 17 between adjacent transverse webs 15 can also still be filled completely or partly with an electrically insulating material. This filler material can serve as a spacer between adjacent transverse webs 15 and prevent an unwanted ignition of arcs which could arise if adjacent transverse webs 15 come too close to one another due to magnetic interaction, thermal effects and/or external vibrations.

REFERENCE NUMERAL LIST

1 first resistor plate
12 second resistor plate
13 third resistor plate
15 transverse web
17 intermediate space
19 connection web
21 end connector web
23 center connector web
25 active region
31 fastening opening
33 fastening element
35 hexagon nut
37 electrically insulating spacer
39 electrically conductive spacer
41 connector opening
43 connector bolt
45 connection opening
47 connection screw
49 insulator block
51 mica pipe
L longitudinal direction
Q transverse direction

The invention claimed is:

1. An electric power resistor which has a stack of a plurality of resistor plates of metal, wherein each resistor plate has at least one meandering structure which is formed by a plurality of alternately mutually connected transverse webs, wherein resistor plates following one another in the stack direction are rotated by 90° with respect to one another.

2. A power resistor in accordance with claim 1, wherein all resistor plates of the stack are fastened to one another by means of a common fastening device.

3. A power resistor in accordance with claim 1, wherein the resistor plates are quadrangular, with a fastening opening being provided in the region of each corner for receiving a respective fastening element.

4. A power resistor in accordance with claim 3, wherein the resistor plates are fastened to one another via fastening bars which are led through the fastening openings of the resistor plates.

5. A power resistor in accordance with claim 3, wherein, the fastening elements are electrically insulated from the resistor plates.

6. A power resistor in accordance with claim 3, wherein the arrangement of the fastening openings and fastening elements is symmetrical with respect to a rotation of the respective resistor plates by 90°.

7. A power resistor in accordance with claim 1, wherein at least two of the resistor plates have at least one respective connector means for an electrical contacting.

8. A power resistor in accordance with claim 1, wherein at least one of the resistor plates has at least one respective connection means for fastening an insulator.

9. A power resistor in accordance with claim 1, wherein two resistor plates following one another in the stack direction are separated from one another by spacers, with the spacers being made selectively electrically insulating or electrically conductive.

10. A power resistor in accordance with claim 1, wherein the resistor plates have a respective end connector web, which is made wider than the transverse webs, at the two ends of the meandering structure.

11. A power resistor in accordance with claim 1, wherein the resistor plates have at least one center connector web, which is made wider than the transverse webs, in a center region.

12. A power resistor in accordance with claim 1, wherein the transverse webs are electrically insulated from one another sectionally or over the full length along the intermediate spaces formed between two adjacent transverse webs.

13. A power resistor in accordance with claim 12, wherein the transverse webs are electrically insulated from one another along the intermediate spaces by strip-shaped inserts, by pressed-in, molded or foamed filler material or by a coat.

14. A power resistor in accordance with claim 1, wherein the meandering structure of each resistor plate is formed by alternate incisions.

15. A power resistor in accordance with claim 1, wherein all resistor plates of the stack, or all resistor plates of the stack with the exception of a base plate, are made identical to one another.

16. A power resistor in accordance with claim 1, wherein two resistor plates following one another in the stack direction are separated from one another by spacers, with some of the spacers being electrically insulating and some of the spacers being electrically conductive.

17. An electric power resistor comprising a plurality of resistor plates arranged to a stack along a mounting direction, wherein each resistor plate has a first side and a second side opposite to the first side, wherein each resistor plate comprises at least a first plurality of incisions extending from the first side and a second plurality of incisions extending from the second side, wherein the first plurality of incisions and the second plurality of incisions of each resistor plate are arranged in an alternating order along the resistor plate, and wherein resistor plates following one another in the mounting direction of the stack are rotated by 90° with respect to one another.

18. An electric power resistor in accordance with claim 17, wherein the first plurality of incisions of each resistor plate extends parallel to one another, and wherein the second plurality of incisions of each resistor plate extends parallel to one another and parallel to the first plurality of incisions of the same resistor plate.

19. An electric power resistor in accordance with claim 17, wherein the first plurality of incisions of each resistor plate extends along a first direction, and wherein the first plurality of incisions and the second plurality of incisions of each resistor plate overlap when viewed along a direction perpendicular to the first direction.

* * * * *